United States Patent [19]

Rebuck et al.

[11] 4,134,843

[45] Jan. 16, 1979

[54] DEUTERATED LUBRICANT

[75] Inventors: Neal D. Rebuck, Southampton; Alfeo A. Conte, Jr., Warrington, both of Pa.

[73] Assignee: The United States of America as represented by the Secretary of the Navy, Washington, D.C.

[21] Appl. No.: 775,238

[22] Filed: Mar. 7, 1977

[51] Int. Cl.[2] ..... C10M 1/10; C10M 3/02; C10M 1/16; C10G 41/00

[52] U.S. Cl. ..... 252/28; 208/18; 208/19; 252/18; 252/25; 252/59; 252/387; 252/401

[58] Field of Search ..... 252/18, 28, 25, 59, 252/387, 401; 208/18, 19

[56] References Cited

U.S. PATENT DOCUMENTS

| | | | |
|---|---|---|---|
| 3,746,634 | 7/1973 | Atkinson et al. | 252/41 |
| 3,753,906 | 8/1973 | Burton | 252/28 |
| 3,763,042 | 10/1973 | Gannon et al. | 252/28 |
| 3,809,647 | 5/1974 | Baudouin | 252/28 |
| 3,844,955 | 10/1974 | Green | 252/28 |
| 3,876,521 | 4/1975 | Atkinson et al. | 252/41 |

*Primary Examiner*—Irving Vaughn
*Attorney, Agent, or Firm*—R. S. Sciascia; Henry Hansen; Stanton D. Weinstein

[57] ABSTRACT

A mixture of nondeuterated and partially or fully deuterated hydrocarbon lubricants. Such a mixture exhibits substantially improved bearing performance life and oxidation resistance, without having fully deuterated the entire lubricant.

16 Claims, No Drawings

DEUTERATED LUBRICANT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to lubricants, and more particularly to hydrocarbon lubricants containing deuterium.

Oxidation is a serious problem in the use of hydrocarbon lubricants. When hydrocarbons are oxidized by the ambient air, acidic products form which deteriorate the lubricant. If the hydrocarbon is being used to lubricate metal surfaces, these acidic products of oxidation also corrode the metal. In addition, oxidation thickens the lubricant, so that lubricant flow is thereby impaired. Poor oxidation resistance thus means a shorter effective life for the lubricant. In contrast, a lubricant with good oxidation resistance can withstand higher temperatures and has a longer effective life. As a result, there is less downtime and teardown of equipment utilizing lubricants having good oxidation resistance.

One practice to improve the oxidation resistance of a hydrocarbon lubricant has been deuteration, wherein the hydrogen atoms covalently bound to carbon atoms in the hydrocarbon molecule are replaced with deuterium atoms. Deuterium is a non-radioactive isotope of hydrogen which is sometimes called heavy hydrogen. The carbon-deuterium chemical bond is stronger, more stable and reacts more slowly than the carbon-hydrogen chemical bond, so that the rate of oxidation for a deuterocarbon (partially or fully deuterated hydrocarbon) lubricant is substantially less than that for an undeuterated hydrocarbon lubricant. In addition, deuteration of a lubricant does not affect most of the lubricant's other chemical properties such as lubricity, which would be affected if oxidation resistance additives or inhibitors were used with a lubricant instead of deuteration. Deuteration of high molecular weight hydrocarbons can be accomplished by the method disclosed in U.S. Pat. Nos. 3,746,634 and 3,876,521 to Joseph G. Atkinson et al, wherein deuteration is effected with deuterium gas in the presence of a Group VII or VIII metal catalyst at a temperature between about 100° and 300° C. The deuterium gas used to exchange with the hydrogen atoms in the hydrocarbon is generally obtained from the electrolysis of heavy water ($D_2O$) which is present in ordinary water at 0.004% concentration levels. Isolating and obtaining a supply of heavy water and deuterium gas is expensive, so that the deuteration of hydrocarbons is expensive.

SUMMARY OF THE INVENTION

Accordingly, it is a general purpose of the present invention to provide a lubricant having good oxidation resistance.

Other objects of the present invention are to provide a lubricant which has good oxidation resistance and improved bearing performance life without full deuteration, and which is less expensive to produce than fully deuterated lubricants.

Further objects of the present invention are to provide a lubricant capable of withstanding high temperatures, having a longer effective service life, which retains most hydrocarbon chemical properties, and which causes less downtime of mechanisms utilizing that lubricant due to lubricant breakdown.

Briefly, these and other objects of the invention are accomplished by a mixture comprising nondeuterated and partially or fully deuterated hydrocarbon lubricants. The mixture exhibits substantially improved bearing performance life and oxidation resistance superior to that of an unmixed lubricant deuterated to an equivalent atom percent deuterium concentration level, as well as that of a nondeuterated hydrocarbon lubricant, without having fully deuterated the lubricant mixture.

Other objects, advantages, and novel features of the invention will become apparent from the following detailed description of the invention.

DESCRIPTION OF THE PREFERRED EMBODIMENT

In accordance with the present invention, there is provided an oxidation resistant deuterocarbon-hydrocarbon lubricant comprising a complete admixture of nondeuterated or undeuterated hydrocarbon fluid and partially or fully deuterated hydrocarbon fluid, prepared by mixing using any conventional means.

The lubricant of the present invention comprises a first hydrocarbon fluid, and a second hydrocarbon fluid wherein a quantity of the hydrogen atoms of the hydrocarbon molecules contained therein have been replaced with deuterium atoms. The second hydrocarbon fluid can contain at least 51 atom percent deuterium with respect to the sum of hydrogen and deuterium atoms present in said second fluid. The lubricant can contain at least 25 atom percent deuterium with respect to the sum of hydrogen and deuterium atoms present in said lubricant. The lubricant can further comprise an amount in the range of from 16 to 20 percent by volume of a gelling agent. The gelling agent can have a melting point of at least 450° F. The gelling agent can for example comprise a modified clay thickener, which can for example comprise dimethyldioctadecyl ammonium bentonite. The lubricant can further comprise an amount in the range of from 0.05 to 0.1 percent by volume of a corrosion inhibitor, which can for example comprise sodium nitrite. The lubricant can further comprise an amount in the range of from 1.5 to 2.2 percent by volume of an oxidation inhibitor selected from the group consisting of amine oxidation inhibitors and phenol oxidation inhibitors. The oxidation inhibitor can comprise an amount in the range of from 0.5 to 1.0 percent by volume of phenyl-alpha-naphthylamine, and an amount in the range of from 1.0 to 1.2 percent by volume of octylated diphenylamine.

The following formulation examples are illustrative of the invention and are not to be construed as limiting. In the examples, the oxidation resistance of synthetic hydrocarbon greases of various deuterations is measured in terms of bearing performance life using ASTM Test Method No. D3336-75 at 400° F., 10,000 rpm, 3 pounds thrust load and 5 pounds radial load, using SAE No. 204 size test bearings fabricated from M-10 tool steel with retainers fabricated from heat-treated silver-plated beryllium copper, Navy Type spindles and the high-temperature test cycle. Test data for unmixed greases of various deuterations and mixed deuterated and nondeuterated greases is given below. It should be understood that an unmixed grease or lubricant does not include a mixture of deuterated and nondeuterated lubricants. Each such grease includes the following ingredients in the following proportions by volume:

| Ingredients | Volume % |
|---|---|
| synthetic hydrocarbon lubricating oil having an average molecular weight of 515 while nondeuterated, specific gravity of 0.8285, kinematic viscosity at 210° F of 5.71 centistokes, and kinematic viscosity at 100° F of 31.6 centistokes | 79.1 |
| dimethyldioctadecyl ammonium bentonite | 18.6 |
| phenyl-alpha-naphthylamine | 1.0 |
| octylated diphenylamine | 1.2 |
| sodium nitrate | 0.1 |

If the oil is to be deuterated, deuteration is accomplished before the oil is combined with the other grease ingredients. Any other synthetic hydrocarbon lubricating oil having different properties can be substituted for the oil listed above. The bentonite is a modified clay thickener which serves as a high melting point gelling agent; any other high melting point gelling agent can be substituted therefor. Sodium nitrite serves as a corrosion inhibitor; any other corrosion inhibitor can be substituted therefor. Phenyl-alpha-naphthylamine and octylated diphenylamine serve as oxidation inhibitors. It should be understood, as can be seen from the data given below, that deuteration of the oil increases its oxidation resistance, but addition of an oxidation inhibitor enhances this property although it is not absolutely necessary. Furthermore, any other amine oxidation inhibitors or phenol oxidation inhibitors can be used in lieu of the inhibitors listed above. The proportions of ingredients given above can be varied, particularly in the event of substitution of ingredients, as desired. For example, the four ingredients listed above can be combined in the following proportions by volume:

| Ingredients | Volume % |
|---|---|
| synthetic hydrocarbon lubricating oil having an average molecular weight of 515 while nondeuterated, specific gravity of 0.8285, kinematic viscosity at 210° F of 5.71 centistokes, and kinematic viscosity at 100° F of 31.6 centistokes | 77.7 - 81.7 |
| dimethyldioctadecyl ammonium bentonite | 16 - 20 |
| phenyl-alpha-naphthylamine | 0.5 - 1.0 |
| octylated diphenylamine | 1.0 - 1.2 |
| sodium nitrite | 0.05 - 0.1 |

For preparation of the grease, the gelling agent and corrosion inhibitor are dispersed with agitation in one third of the total amount of oil to be included in the grease. To this blend, acetone, in an amount by weight equal to 2% of the total weight of the other ingredients, is then added and the resulting mixture is mixed for thirty minutes. The remaining oil is heated to 250° F., and the oxidation inhibitor is then added thereto with constant stirring. The temperature of this second mixture is then raised to 300° F. for thirty minutes with continued stirring, which is followed by slow cooling to 180° F. The two mixtures are then blended by hand and are put through a three-roll mill three times at a setting of 0.015 inch. The resulting grease is then allowed to stand for one week before being packed into the test bearing. The above procedure is performed using zero, 51, 73, 88, 94 and 97 atom percent deuterated synthetic hydrocarbon oils in succession. Portions of grease containing nondeuterated oil and portions of grease containing 97 atom percent deuterated oil are then mixed together by hand and are put through a three-roll mill once at a setting of 0.015 inch to produce respective grease mixtures containing 25, 48.5 and 75 atom percent overall concentration levels of deuterium in the oils contained therein. Since deuterium is heavier than hydrogen, deuteration increses the molecular weight and overall weight of a hydrocarbon lubricant. Accordingly, the proportions of deuterocarbon lubricant and hydrocarbon lubricant to be mixed are by volume and not weight, in determining the amount of each lubricant to be used in order to obtain the desired atom % deuterium in the resulting mixture. For a mixture of a nondeuterated lubricant and a deuterated lubricant, the atom percent deuterium for the mixture is equal to the atom percent deuterium in the deuterated lubricant multiplied by the volume percent of the deuterated lubricant in the mixture. Thus, mixing equal parts by volume of nondeuterated and 97 atom % as deuterated lubricant yields a mixture having 48.5 atom percent deuterium.

Table I sets forth oxidation resistance results in terms of hours of bearing performance life for unmixed hydrocarbon greases of different proportions of deuteration. The average bearing performance life hours for each atom percent deuteration is set forth immediately below the individual test results for greases of that deuteration. The bottom line of Table I sets forth the ratio of this average for each atom percent deuteration versus the average for the undeuterated grease.

TABLE I

| | ATOM % DEUTERIUM | | | | | |
|---|---|---|---|---|---|---|
| TEST NO. | 0 | 51 | 73 | 88 | 94 | 97 |
| 1 | 87 | 77 | 120 | 172 | 342 | 540 |
| 2 | 94 | 83 | 128 | 102 | 300 | 527 |
| 3 | 97 | 102 | 143 | 183 | 358 | 503 |
| 4 | 104 | 126 | 123 | 120 | 319 | 510 |
| 5 | 85 | 103 | | | | |
| 6 | 94 | 109 | | | | |
| 7 | 88 | | | | | |
| 8 | 137 | | | | | |
| AVERAGE | 98 | 100 | 129 | 144 | 330 | 520 |
| RATIO | 1.0 | 1.02 | 1.3 | 1.5 | 3.4 | 5.3 |

Table II sets forth the results under the same test and the same conditions for various mixtures of different proportions of undeuterated and 97 atom percent or greater deuterated synthetic hydrocarbon greases, arranged according to the atom percent deuterium present in the mixture tested, each spindle being used for testing of mixtures of three different atom percents deuterium.

TABLE II

| | Atom % Deuteration (Admixed) | | | |
|---|---|---|---|---|
| Spindle No. | 0 | 25 | 48.5 | 75 |
| 1 | 79 | | 196 | 201 |
| | 57 | | 130 | 182 |
| 2 | 82 | 101 | 267 | |
| | 102 | 93 | 228 | |
| 3 | 125 | | 219 | 260 |
| | 70 | | 246 | 242 |

Table III sets forth the oxidation resistance in terms of average hours of bearing performance life for the test results of Table II.

TABLE III

| | Atom % Deuteration (Adimixed) | | | |
|---|---|---|---|---|
| Spindle No. | 0 | 25 | 48.5 | 75 |
| 1 | 68 | | 163 | 192 |

TABLE III-continued

| Spindle No. | Atom % Deuteration (Adimixed) 0 | 25 | 48.5 | 75 |
|---|---|---|---|---|
| 2 | 92 | 97 | 248 | |
| 3 | 98 | | 233 | 251 |

Table IV sets forth the ratio of average hours of bearing performance life for the test mixture versus average hours of bearing performance life for the undeuterated grease in the testing of Table II.

TABLE IV

| Spindle No. | Atom % Deuteration (Admixed) 0 | 25 | 48.5 | 75 |
|---|---|---|---|---|
| 1 | 1.0 | | 2.4 | 2.8 |
| 2 | 1.0 | 1.1 | 2.7 | |
| 3 | 1.0 | | 2.4 | 2.6 |

Since the mixture tested was of nondeuterated and 97 atom % as deuterated synthetic hydrocarbon lubricant, the bearing performance life data for a 97 atom % deuterated admixed deuterocarbon-hydrocarbon lubricant would be similar to the bearing performance life data for the 97 atom % as deuterated unmixed lubricant given in Table I.

As can be seen in Tables II, III and IV, by mixing undeuterated and deuterated hydrocarbon lubricants, a formulation is obtained which exhibits a substantially improved bearing performance life at an overall deuterium concentration level well below 94 atom percent. For example, by mixing equal volumes of nondeuterated and 97 atom percent as deuterated synthetic hydrocarbon greases, a formulation is obtained which exhibits substantially improved bearing performance life (140% to 170% increase) at a deuterium concentration level of 48.5 atom percent admixed. As can be seen from Table I, 94 or greater atom percent deuteration is required in order to achieve substantially enhanced lubricating properties, preferably 97 or greater atom percent deuteration, for the synthetic hydrocarbon grease. In contrast, however, as shown in Tables II, III and IV, oxidation resistance is measurably increased for an admixed lubricant having as little as 48.5 atom percent deuterium overall, over a lubricant which is undeuterated or partially deuterated to the same deuteration level as that of the mixture. Thus, a 48.5 percent deuterated mixture has 135 to 165 percent better bearing performance life than an unmixed lubricant partially deuterated to a 51 percent deuteration level. This improvement, for mixtures having 75 atom percent deuterium, is a 100 percent to 115 percent increase over partially deuterated greases having 73 atom percent deuterium content. As indicated by the above test data, partial deuteration of unmixed lubricants does not result in substantially improved lubricant properties. However, mixing of a nondeuterated lubricant with a highly deuterated lubricant to produce a partially deuterated lubricant does result in lubricant properties which are substantially improved over those of both a nondeuterated lubricant and an unmixed lubricant deuterated to an equivalent atom percent deuterium concentration level as that of the mixed lubricant.

It should be understood that, in the practice of this invention, any deuterated synthetic hydrocarbon lubricant and any undeuterated synthetic hydrocarbon lubricant can be mixed. These lubricants can be lubricating oils, oils with additives, greases or other lubricants. The synthetic hydrocarbon and deuterocarbon lubricating fluids can be mixed without additives and without being first formed into a grease. Also, after the deuterocarbon-hydrocarbon lubricant mixture is formed, it can be combined with additives or formed into a grease. In addition, the deuterated and undeuterated lubricants can be mixed by any conventional means or manner, such as by hand, spatula, three-roll mill, colloid mill, homogenizer, egg-beater, mixer, or open or closed paddle kettle, with or without steam jacket or electric or other heating means. Furthermore, since data given in Table I shows that the 94 atom percent deuterated lubricant has good oxidation resistance comparable to that of the 97 atom percent deuterated lubricant, the deuterocarbon lubricant component of the present invention can have 94 or greater atom percent deuterium.

Thus there has been provided a novel deuterocarbon-hydrocarbon lubricant which has good oxidation resistance and improved bearing performance life without full deuteration but without the disadvantages of partially deuterated lubricants, and which requires substantially less deuterium and is less expensive to produce than fully deuterated lubricants. This lubricant exhibits substantially improved bearing performance life and oxidation resistance superior to that of an unmixed lubricant deuterated to an equivalent atom percent deuterium concentration level, as well as that of a nondeuterated hydrocarbon lubricant, without having fully deuterated the lubricant mixture. Also, the deuterocarbon-hydrocarbon lubricant is capable of withstanding high temperatures and retains most hydrocarbon lubricant properties. In addition, the deuterocarbon-hydrocarbon lubricant has a longer effective service life, and causes less downtime, due to lubricant breakdown, of mechanisms utilizing that lubricant.

Obviously, many modifications and variations of the present invention are possible in light of the above teachings. It is therefore to be understood that within the scope of the appended claims the invention may be practiced otherwise than as specifically described.

What is claimed is:

1. A lubricant, comprising:

a first nondeuterated hydrocarbon fluid; in admixture with a second hydrocarbon fluid wherein a quantity of the hydrogen atoms of the hydrocarbon molecules contained therein have been replaced with deuterium atoms.

2. A lubricant as defined in claim 1 wherein at least 94 atom percent of the hydrogen atoms of the hydrocarbon molecules contained in said second fluid have been replaced with deuterium atoms.

3. A lubricant as defined in claim 2 wherein said lubricant contains at least 25 atom percent deuterium with respect to the sum of hydrogen and deuterium atoms present in the hydrocarbon molecules contained in said lubricant.

4. A lubricant as defined in claim 2 wherein said second fluid is present in said lubricant in an amount in the range of from 25 to 75 volume percent of the total volume of said first and second fluids contained in said lubricant.

5. A lubricant as defined in claim 4, further comprising an amount in the range of from 16 to 20 percent by volume of a gelling agent.

6. A lubricant as defined in claim 5, wherein said gelling agent comprises a gelling agent having a melting point of at least 450° F.

7. A lubricant as defined in claim 6, wherein said gelling agent comprises a modified clay thickener.

8. A lubricant as defined in claim 7, wherein said modified clay thickener comprises dimethyldioctadecyl ammonium bentonite.

9. A lubricant as defined in claim 4 wherein said first and second hydrocarbon fluids each comprise synthetic hydrocarbon lubricating oil having an average molecular weight of 515 while nondeuterated, specific gravity of 0.8285, kinematic viscosity at 210° F. of 5.71 centistokes, and kinematic viscosity at 100° F. of 31.6 centistokes.

10. A lubricant as defined in claim 4 wherein said first and second fluids are synthetic.

11. A lubricant as defined in claim 2 wherein said second hydrocarbon fluid has 97 atom percent or greater deuteration.

12. A method of making a lubricant, comprising the steps of:

deuterating a first hydrocarbon fluid; and mixing with said first hydrocarbon fluid a second nondeuterated hydrocarbon fluid to form said lubricant.

13. A method as defined in claim 12 wherein the step of deuterating said first fluid comprises replacing at least 94 atom percent of the hydrogen atoms of the hydrocarbon molecules contained in said first fluid with deuterium atoms.

14. A method as defined in claim 13 wherein the step of mixing said first and second fluids comprises mixing said first and second fluids in a ratio in parts by volume of said first fluid to said second fluid in a range of from 1:3 to 3:1.

15. A method as defined in claim 14 wherein said first and second fluids each comprise synthetic hydrocarbon lubricating oil having an average molecular weight of 515 while nondeuterated, specific gravity of 0.8285, kinematic viscosity at 210° F. of 5.71 centistokes, and kinematic viscosity at 100° F. of 31.6 centistokes.

16. A method as defined in claim 13 wherein the step of deuterating said first fluid comprises deuterating said first fluid to 97 atom percent or greater deuteration.

* * * * *